United States Patent [19]

Wiedemann et al.

[11] 3,989,172

[45] Nov. 2, 1976

[54] FOLDING DEVICE FOR SHIRTS

[75] Inventors: Heinz Wiedemann, Fuerth; Alfred Pielach, Herzogenaurach; Kurt Behre, Osnabrueck, all of Germany

[73] Assignee: Firma Grossversandhaus Quelle Gustav Schickedanz KG, Fuerth, Germany

[22] Filed: Aug. 15, 1975

[21] Appl. No.: 604,965

[30] Foreign Application Priority Data

Aug. 16, 1974 Germany ..... 7427718[U]

[52] U.S. Cl. ..... 223/71; 223/37

[51] Int. Cl.[2] ..... A41H 5/00

[58] Field of Search ..... 206/278, 292, 295, 296, 206/297, 299; 223/71, 1, 37

[56] References Cited

UNITED STATES PATENTS

| | | | |
|---|---|---|---|
| 2,563,043 | 8/1951 | Kahn | 223/71 |
| 2,615,601 | 10/1952 | Kahn | 223/71 |

FOREIGN PATENTS OR APPLICATIONS

| | | | |
|---|---|---|---|
| 87,089 | 1/1956 | Norway | 223/71 |

*Primary Examiner*—G. V. Larkin

*Attorney, Agent, or Firm*—Frank J. Jordan

[57] ABSTRACT

A device for folding a shirt includes a stiffening panel about which the shirt is adapted to be folded. The stiffening panel has a slit for insertably receiving a sleeve of the shirt such that the slit is operable to clampingly fasten the shirt to the stiffening panel and thereby obviate the need for pins.

4 Claims, 5 Drawing Figures

FOLDING DEVICE FOR SHIRTS

BACKGROUND OF THE INVENTION

This invention relates to a device for folding shirts with a substantially oblong stiffening panel and also to the combination of a shirt and stiffening panel which provides that when the shirt is folded together with the stiffening panel, the shirt is ready for sale.

Heretofore, shirts have been folded over sidewise several times upon their backside on a stiffening panel and the folded shirt is locked in its folded position by a multiplicity of pins, whereby a large part of the pins serve as a direct connection between the shirt and the stiffening panel.

The method of folding over and fastening of a shirt unto a stiffening panel is not only very cumbersome, time consuming and therefore expensive, but has also the disadvantage that the purchaser or consumer — in case he overlooks one of the many pins — either tears the shirt at that spot when he unfolds it or he might hurt himself.

In order to overcome the disadvantages of these known arrangements, the present invention provides a slit in a stiffening panel, the slit being disposed along the longitudinal median line of the stiffening panel. The slit is adapted to have inserted therein a sleeve and serves to clampingly fasten the sleeve.

A stiffening panel made according to the present invention permits folding of a shirt where pins are no longer required to fasten the shirt unto the stiffening panel. The stiffening panel includes a substantially T-shaped projection provided for in an extension of the present invention, such projection being connected to the stiffening panel and being arranged to be inserted or tucked underneath the collar of the shirt in order to stiffen the collar.

The desired objective is effected substantially by a double connection, free of pins, between the shirt and the stiffening panel, once by the connection of the stiffening panel with the shirt collar by means of collar stiffening strips at the upper projection of the stiffening panel and also by the slit in the stiffening panel through which the sleeve is pulled rearwardly after partially surrounding the stiffening panel.

In a particularly advantageous manner the shirt, ready for sale and folded as described above, is obtained by providing that the sleeve of a first side strip of the shirt is folded around a first lateral edge of the stiffening panel and is pulled around the second lateral edge of the stiffening panel and pulled from the rear through the slit, whereby the slit is only formed as a cut or slit in order that the slit really clamps the shirt when the panel springs back into a flat position. The second sleeve is folded back approximately V-shaped lying upon the backside, its cuff being laid around the second lateral edge forwardly upon the front of the shirt. The lower rim strip of the upwardly folded lower part of the shirt is folded or tucked between the folded-over sleeves. The sleeves may be fastened together in the area of the upper arms and the stiffening panel. The stiffening panel is shorter than the half length of the shirt.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A device for folding a shirt includes a stiffening panel about which the shirt is adapted to be folded. The stiffening panel has a slit for insertably receiving a sleeve of the shirt such that the slit is operable to clampingly fasten the shirt to the stiffening panel and thereby obviate the need for pins.

DESCRIPTION OF THE PREFERRED EMBODIMENTS

Figure 1:
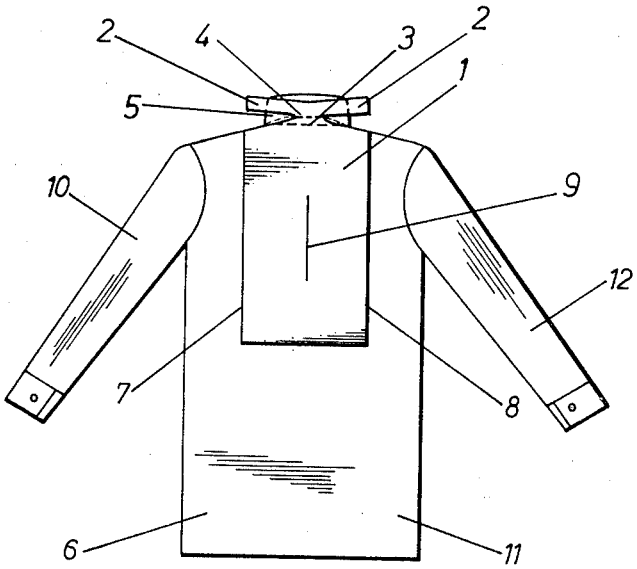
FIG. 1 is a rear view of a shirt and a stiffening panel according to the present invention, prior to folding over of the shirt.
Figure 3:
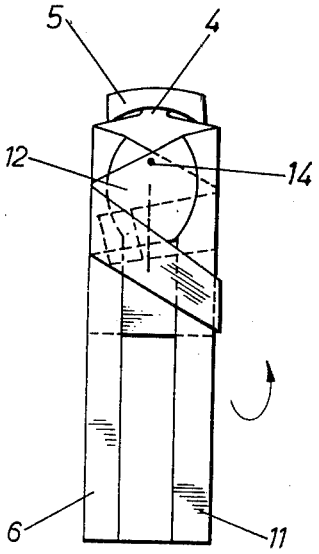
FIG. 3 is a rear view of the shirt after the subsequent folding over of the second side strip of the shirt.
Figure 2:
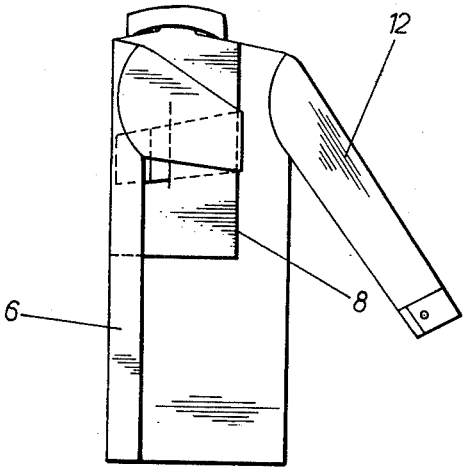
FIG. 2 is a rear view of a shirt after folding over of one side strip of the shirt, while the corresponding sleeve is inserted into the slit in the stiffening panel.

Referring to the drawings, a shirt is first laid upon a packing table face down, and a stiffening panel according to the present invention is laid on the back portion of the shirt. A projection 4 on the stiffening panel 1 is pushed underneath the shirt collar 5 with the projection 4 being preferably provided with a collar stiffening strip 2 connected to the stiffening panel 1 by a folding edge or portion 3. Thus, it can be seen that the arrangement described above provides a relatively good rigid connection obtained between the stiffening panel 1 and the shirt, a connection which was heretofore obtained by pins.

Subsequently, one sleeve, that is the left sleeve 10 in the drawings is grasped and, after having folded the respective shirt side strip 6 over the first lateral edge 7 of the stiffening panel 1, the sleeve 10 is folded about the second longitudinal edge 8, and pulled from the rear through a slit 9 in the stiffening panel 1. The slit 9 is only prepared as a longitudinal cut and not as a wide die cut, in order to exert a good clamping action upon the sleeve 10. The aforedescribed action cooperates with the fastening of the stiffening panel 1 unto the shirt by the projection 4 which reaches under the shirt collar 5 and results in an unslidable fastening of the shirt to the stiffening panel 1.

Figure 5:
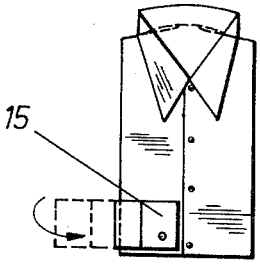
FIG. 5 is a front view of the fully folded shirt.

After folding over of the second shirt side strip 11 around the second lateral edge 8 of the stiffening panel 1, the right sleeve 12 is folded or laid down in a substantially V-shaped manner and the cuff 15 is folded frontwards upon the shirt breast (FIG. 5).

Figure 4:
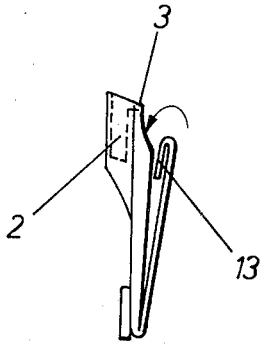
FIG. 4 is a side view of the shirt just prior to the final finishing step of inserting the lower part of the shirt between the folded-over sleeves and the stiffening panel.

Subsequently, the part of the shirt which lies below is folded or pulled upwardly, tightened, and folded or tucked in behind the sleeves (FIG. 4). In this regard, no pin is needed, because the sleeve 10 which had been pulled through the slit 9 of the stiffening panel 1 sits and is held so tightly that the sleeve 10 is capable of fixing clampingly the folded-over lower rim strip 13 between itself and the stiffening panel 1.

It is possible to clamp together the upper areas of the sleeves 10, 12 at the place denoted by the numeral 14 or to fix them by any other method, for example by a knotted thread. This additional fastening of the sleeves is not absolutely necessary and causes no considerable diminution of the advantages of the device for the folding without pins, particularly when it is considered that heretofore there were required twelve pins for the usual folding of a shirt and its fastening to a stiffening panel.

There is no need to fasten the cuff 15 of the sleeve 12 which is folded forwards over the shirt breast because such folded shirts are usually packed in transparent containers or covers. However, a U-clamp may be used at this place for additional fastening.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A method for folding a shirt on a stiffening panel having a slit, said shirt having a main panel substantially equal to the width of said stiffening panel and side panels on either side of said main panel with a sleeve extending from each side panel, comprising the steps of superimposing said stiffening panel on the back of the main panel of said shirt, folding one of said side panels over a lateral edge of said stiffening panel such that said one side panel extends over the back of said stiffening panel, folding a first sleeve extending from said one side panel over the other lateral edge of said stiffening panel to extend between the front of said stiffening panel and said shirt, passing said first sleeve through said slit in said stiffening panel from front to back such that the cuff of the said first sleeve is disposed on the back of said stiffening panel, folding the other of said side panels over the other lateral edge of said side panel, folding the second shirt sleeve of said other side panel in a substantially V-shaped configuration on the back of said stiffening panel, folding the cuff of said second sleeve about said other lateral edge to extend the cuff thereof to the front of the shirt, folding the shirt about the lower edge of said stiffening panel to extend over the back of said stiffening panel, and tucking the lower edge portion of the shirt in between said stiffening panel and said folded over sleeves, whereby said slit in said stiffening panel clampingly fastens said shirt to said stiffening panel.

2. A method according to claim 1 including fastening said first and second sleeves to one another at the upper arm portions thereof.

3. A method according to claim 1 wherein said stiffening panel is provided with a projection extending from the upper edge thereof, and disposing said projection under the collar of said shirt.

4. A method according to claim 1 wherein said stiffening panel has a length less than one-half the length of said shirt.

* * * * *